US010099845B2

(12) United States Patent
Knudsen

(10) Patent No.: US 10,099,845 B2
(45) Date of Patent: Oct. 16, 2018

(54) HINGED LID PACKAGE FOR SMOKING AND/OR TOBACCO RELATED ARTICLES, BLANK AND METHOD THEREFOR

(71) Applicant: REEMTSMA CIGARETTENFABRIKEN GMBH, Hamburg (DE)

(72) Inventor: Jörg Knudsen, Norderstedt (DE)

(73) Assignee: REEMTSMA CIGARETTENFABRIKEN GMBH, Hamburg (DE)

( * ) Notice: Subject to any disclaimer, the term of this patent is extended or adjusted under 35 U.S.C. 154(b) by 112 days.

(21) Appl. No.: 15/029,405

(22) PCT Filed: Oct. 14, 2014

(86) PCT No.: PCT/EP2014/072037
§ 371 (c)(1),
(2) Date: Apr. 14, 2016

(87) PCT Pub. No.: WO2015/055665
PCT Pub. Date: Apr. 23, 2015

(65) Prior Publication Data

US 2016/0272408 A1 Sep. 22, 2016

(30) Foreign Application Priority Data

Oct. 14, 2013 (EP) ..... 13188580

(51) Int. Cl.
*B65D 85/10* (2006.01)
*A24F 15/12* (2006.01)
(Continued)

(52) U.S. Cl.
CPC ..... *B65D 85/1045* (2013.01); *A24F 15/12* (2013.01); *B65D 5/2047* (2013.01);
(Continued)

(58) Field of Classification Search
CPC ..... A24F 15/12; A24F 15/16; A24F 15/06; B65D 2251/04; B65D 5/5206; B65D 5/66;
(Continued)

(56) References Cited

U.S. PATENT DOCUMENTS 602,664 A * 4/1898 Munson ..... B65D 85/1045 206/268
1,347,839 A * 7/1920 Coons ..... B65D 5/5206 206/45.23
(Continued)

FOREIGN PATENT DOCUMENTS

AT 336487 5/1977
GB 1121303 7/1968
(Continued)

OTHER PUBLICATIONS

International Search Report and Written Opinion for PCT Application No. PCT/EP2014/ 072037, dated Feb. 2, 2015.
Office Action for RU201600289 dated Feb. 28, 2018, 4 pages.

*Primary Examiner* — Anthony Stashick
*Assistant Examiner* — Mollie Impink
(74) *Attorney, Agent, or Firm* — Workman Nydegger

(57) ABSTRACT

The invention relates to a hinged lid package (1) for elongate articles (21), a blank and a method for manufacturing the package (1). The package (1) comprises a body (2) having a rear wall (8), a bottom wall and two side walls (6, 15), the package (1) further comprising a lid (3) which is hinged to the body (2) by a first hinge (10), the lid (3) and the body (2) being coupled such that the body (2) can rest on the lid (3) in the open end position of the lid (3) and the lid (3) remains open, wherein the package (1) further comprises a second hinge (11) inside the rear wall (8) of the body (2).

8 Claims, 5 Drawing Sheets

(51) Int. Cl.
*B65D 5/66* (2006.01)
*B65D 5/52* (2006.01)
*B65D 5/20* (2006.01)

(52) U.S. Cl.
CPC ..... *B65D 5/2052* (2013.01); *B65D 5/526* (2013.01); *B65D 5/66* (2013.01); *B65D 5/6614* (2013.01); *B65D 2251/04* (2013.01)

(58) Field of Classification Search
CPC .... B65D 5/6614; B65D 5/662; B65D 5/6679; B65D 5/6691; B65D 5/5485; B65D 5/5465; B65D 5/543; B65D 85/1009; B65D 85/1045
USPC ..... 206/45.2, 45.21, 45.23
See application file for complete search history.

(56) References Cited

U.S. PATENT DOCUMENTS 3,245,525 A * 4/1966 Shoemaker ..... B65D 75/38 206/249
3,327,887 A * 6/1967 Chalmers ..... B65D 85/10 206/268
2009/0314661 A1 12/2009 Fisher et al.

FOREIGN PATENT DOCUMENTS

JP S61132289 8/1986
WO WO2013/108670 7/2013
WO WO 2017098351 A1 * 6/2017 ..... B65D 85/1045

* cited by examiner

HINGED LID PACKAGE FOR SMOKING AND/OR TOBACCO RELATED ARTICLES, BLANK AND METHOD THEREFOR

CROSS-REFERENCE TO RELATED APPLICATIONS

This application is a 371 Nationalization of PCT Application No. PCT/EP2014/072037, filed Oct. 14, 2014, which claims priority to EP Patent Application No. 13188580.8, filed Oct. 14, 2013, the entire contents of which are incorporated by reference herein.

FIELD OF THE INVENTION

The invention relates to a hinged lid package for elongate articles, in particular smoking and/or tobacco related articles and a blank and a method for manufacturing the hinged lid package.

BACKGROUND

Tobacco related articles, preferably smoking articles like cigarettes or cigarillos, are often contained in disposable packages having a substantially cuboid or parallelepiped shape. A widespread type of a cigarette package is the hinged lid package. In a typical scenario, a hinged lid package is opened, a cigarette is offered to a friend or guest by holding the open package in front of the guest. The guest may remove a cigarette from the package and the host closes the package again. Dependent on the specific situation, it might, however, be desirable to keep the package open in an appealing manner as a sign of generosity or politeness, thereby maintaining the offer without necessitating the guest to ask for another cigarette. This usually requires to remove the cigarettes from the hinged lid package and to place them in an open box. The reason for this is that the conventional hinged lid package automatically closes the lid due to inherent forces in the lid, if the lid is not held open anymore.

SUMMARY

It is an object of the invention to provide a hinged-lid package that allows keeping the hinged-lid open in an appealing manner for offering elongate articles smoking articles or tobacco related articles from the hinged-lid package. It is also an object of the invention to provide a respective method for manufacturing the package and to provide a blank for manufacturing the package.

According to an aspect of the invention, a hinged lid package for elongate articles is provided which comprises a body having at least a rear wall a bottom wall and two side walls. The body may also comprise a front wall. The package further comprises a lid which is hinged to the body (advantageously to the rear wall of the body) by a first hinge. The hinged connection between the lid and the body is further configured such that the package, in particular the body, can rest on the lid in the open end position of the lid. In an embodiment, the lid may face with the first hinge towards a plane on which the open package rests and the lid may touch the plane in the area of the first hinge. The lid can then remain in the open end position and the package can be placed on a surface with its rear side facing the surface and resting on the lid, thereby providing an appealing offer of the elongate articles. The elongate articles are, for example, smoking articles or tobacco related articles, such as cigarettes, e-cigarettes, cigars or snus or the like. The open end position is preferably stable to the extent that any resilient forces provided by the open lid are not high enough to move or lift the package and thereby change the position of the supporting lid, i.e. the lid (or package) cannot return by itself to an at least partly closed position. To this extent, the open end position can also be referred to as a stable open position.

In other words, the package can be configured such that the lid supports the open package in the open end position from the rear side of the package in an appealing position in which the elongate articles are inclined with respect to a flat surface such that the ends of the elongate articles which are accessible are more elevated than the opposite ends of the elongate articles inside the package. In the appealing position, for example the filters of cigarettes may point towards the consumer. It should be noted that all the articles contained in the package are accessible in the open end position, i.e. the package is entirely open and not only a little bit as it may coincidentally occur with a conventional hinged-lid package.

The hinged connection can be configured to reach the open end position of the lid by swiveling the lid in a first direction of rotation for granting access to the elongate articles contained in the package and by swiveling the lid in a second direction of rotation in order to stabilize the lid in the open end position. This kind of playing with the package when opening and closing the package can make the package even more appealing.

The package can further comprise a second hinge inside the rear wall of the package and two cuts in the rear wall. The two cuts may run away from the first hinge inside the rear wall of the package towards the second hinge.

In some embodiments, the cuts can result from perforation lines, weakening lines and/or creasing lines along which the rear wall of the package is ripped up, for example by the consumer. Accordingly, the package can further comprise a second hinge inside the rear wall of the package and two perforation lines, weakening lines or creasing lines in the rear wall. The two lines may run away from the first hinge inside the rear wall of the package towards the second hinge.

The cuts or weakening lines or perforation lines or creasing lines advantageously run from the first hinge to the second hinge. The two cuts or lines can thereby create or define (before the lines are ripped up) a connecting flap in the rear wall which couples the first hinge and the second hinge. A connecting flap provides various additional degrees of freedom regarding the movement and positions of the lid when the lid is opened.

The cuts or lines can run from the first hinge to the second hinge in any manner or shape as long as they do not intersect with each other or get too close to each other.

The cuts or lines can be substantially parallel to each other. The cuts or lines can also be substantially parallel to the side walls of the package. The cuts or lines can have substantially the same length. However, all kinds of shapes and configurations for the two cuts or lines are possible as long as they create a suitable connecting flap.

The cuts or lines can have a distance from the side walls of the package such that the width of the connecting flap is smaller than the width of the rear wall of the package. This aspect allows the ratio of the width of the rear wall and the width of the connecting flap to be adapted in accordance with different materials and sizes of the packages, thereby ensuring sufficient stability and flexibility of the package and the hinged connection between the lid and the package.

Furthermore, the width of the rear wall can be equal to and advantageously larger than the width of the first hinge. Two cuts at the opposite ends of the first hinge can be provided in order to reduce the length of the first hinge. However, in an advantageous embodiment of the invention, the two cuts in the rear wall for providing the connecting flap between the first hinge and the second hinge can further follow the first hinge outwardly in opposite directions and towards the side walls of the package, such that the hinge is partially cut. This aspect provides that only two cuts are required which at the same time provide the cut-out of the connecting flap and reduce the width of the hinge.

Advantageously, the second hinge can be parallel to the first hinge. This provides that the lid rotates and moves within the width of the package.

The front wall of the lid may face towards the rear wall of the body in the open end position. The front wall of the lid and the rear wall of the body can be parallel in the open end position. The front wall of the lid may face towards the rear wall of the body in the open position. This provides better stability in the open end position. Likewise, the top wall of lid can be perpendicular to rear wall of package in the open end position.

The length of the connecting flap can be substantially equal to the length of the lower edges of the side walls of the lid. However, in an embodiment, the length of the connecting flap may also be larger than the length of the lower edges of the side wall of the lid, at least to the extent that a stable open position of the lid is still possible. The lid can then easily be folded into the connecting flap on the rear side of the package.

The package can further be configured such that a front wall of the lid abuts on the rear wall of the package when the lid is in the open end position. The lid can than rest with a front wall on the rear wall of the package which provides for a stable open end position when the lid is placed on a surface.

The package may have various shapes. The package can have a substantially parallelepiped shape. However, the edges of the package can be round or beveled. The cross sectional shape of the package may be semi-octagonal, octagonal or even triangular. The lid of the package may then also have a triangular cross section. This means the front wall of the lid is rather an edge than a wall.

The invention also provides a blank for manufacturing the package according to the aspects and embodiments of the invention. The blank has two cuts running from opposite sides towards the first hinge and from there towards the second hinge in order to create the connecting flap. At the same time, the two cuts reduce the length of the first hinge.

The invention further provides a method of manufacturing a package according to the aspects and embodiments of the invention.

BRIEF DESCRIPTION OF DRAWINGS

Further aspects and characteristics of the invention ensue from the following description of the preferred embodiments of the invention with reference to the accompanying drawings, wherein.

DETAILED DESCRIPTION OF AN EXAMPLE EMBODIMENT

Figure 1:
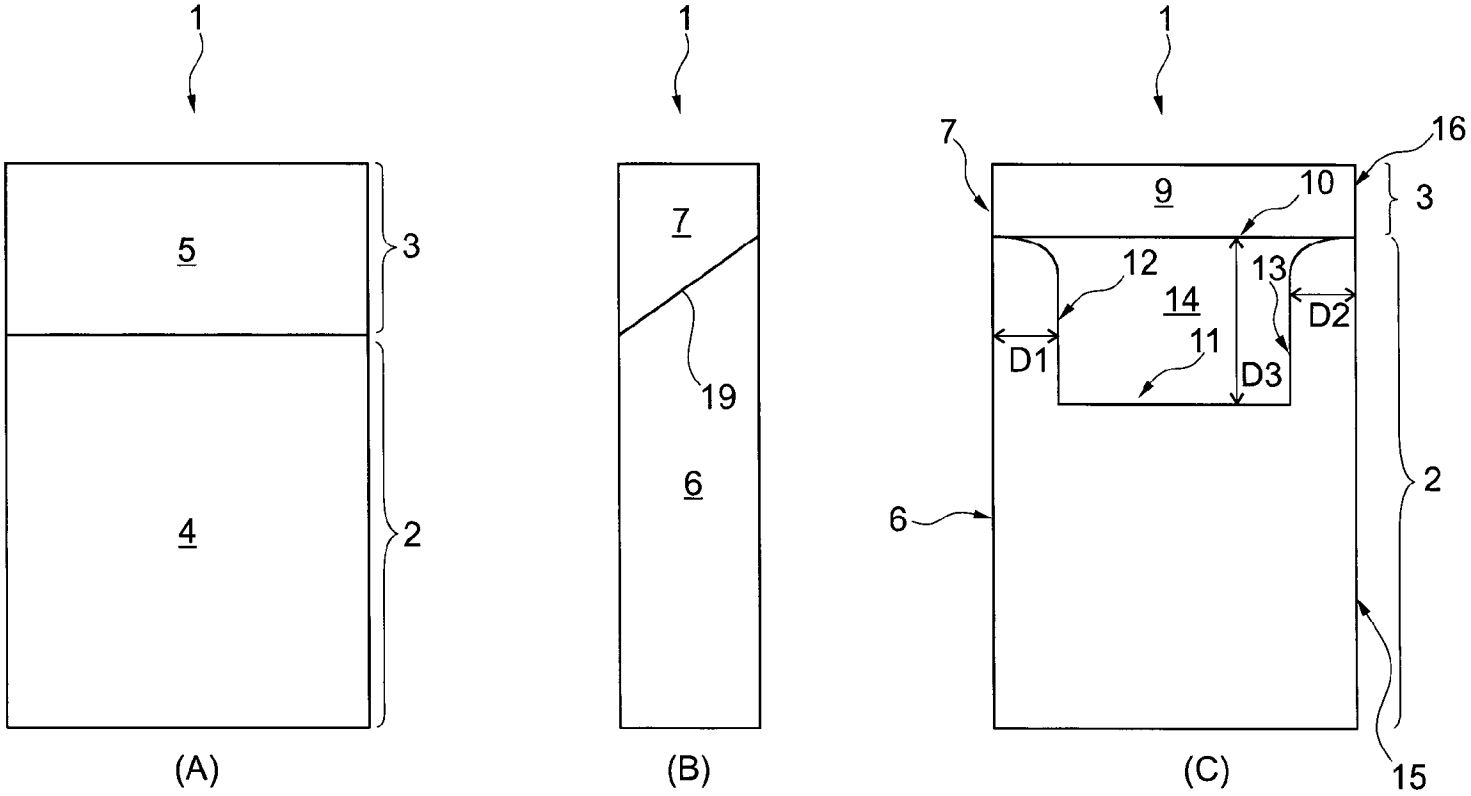
FIG. 1A to FIG. 1C show a simplified plan view on the front of the package, on the side of the package and on the rear of the package according to an embodiment of the invention.

FIGS. 1A to 1C show the package 1 according to an embodiment of the invention from three different sides.

FIG. 1A shows the package 1 from the front side. The package 1 has a body 2 and a lid 3. The body 2 has a front wall 4 and the lid 3 has a front wall 5.

FIG. 1B shows the package 1 from one side, but the respective other side would have a similar appearance. The body 2 has a left side wall 6 and a right side wall 15 (as shown in FIG. 2). Likewise, the lid 3 has a left side wall 7 and a right side wall 16 (as shown in FIG. 2). The lower edge 19 of the side wall 7 of the lid 3 is also indicated. The lower edge of the side wall 16 of the lid 3 has reference number 23 (not visible here but shown in FIG. 4).

FIG. 1C shows the package 1 from the rear side. The body 2 of the package has a rear wall 8 and the lid 3 has a rear wall 9. There is a first hinge 10 by which the lid 3 is hingedly coupled to the body 2. However, the coupling between the body 2 and the lid 3 of the package is further refined according to the aspects of the invention. There are two cuts 12, 13 which cut out a portion of the rear wall 8 of the body 2. This portion is referred to as connecting flap 14. It connects the first hinge 10 and the second hinge 11. More specifically, the two cuts 12 and 13 run from opposite sides of the package 1 a short distance along the first hinge towards the center of the first hinge and then turn into the rear wall 8 substantially parallel to the side walls of the package and for a longer distance, thereby creating the connecting flap 14. In this embodiment, the cut 12 has a distance D1 from the left side wall 6. Likewise, the cut 13 has a distance D2 from the right side wall 15. In this embodiment, cut 12 runs basically parallel to the side wall 6 and away from the first hinge 10 towards the second hinge 11. Likewise cut 13 runs basically parallel to the wall 15 and away from the first hinge 10 towards the second hinge 11. However, the shape and direction of the cuts 12, 13 can be widely varied as long as the connecting flap 14 is created such that the distance D3 between the first hinge 10 and the second hinge 11 is equal to or greater than the length of the lower edges 19, 23 of the side walls 7 and 16 of the lid 3. An advantageous choice is that D3 is about equal to or slightly larger than the length of the lower edges of the side walls 7 and 16.

Figure 2:
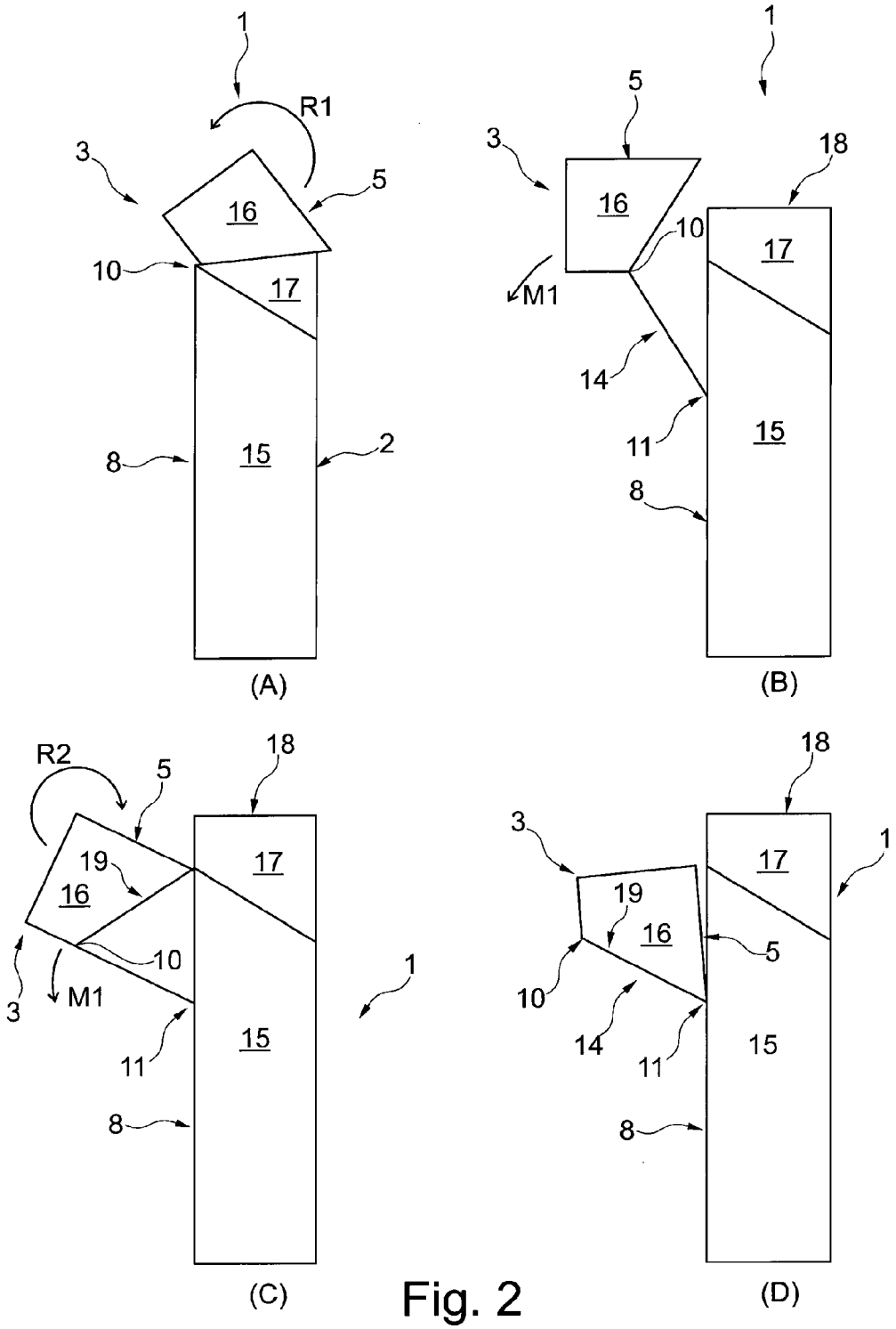
FIG. 2A to FIG. 2D show simplified plan views on the side of the package of FIG. 1 illustrating the opening and fixing procedure of the lid.

FIGS. 2A to 2D show the package 1 of FIG. 1 from the left side (if viewed from the front side of the package) in four different stages of opening and folding the lid 3 into the connecting flap 14.

In FIG. 2A the lid 3 is opened by swiveling the lid 3 around the first hinge 10 according to the conventional way of opening a hinged lid package. The direction of rotation is indicated by an arrow R1. The direction of rotation is counter-clockwise in this perspective (from the left side of the package it would be clockwise). When the package 1 is opened, the collar 17 of the package appears and finally the access opening 18 through which the elongate articles, in this embodiment for example cigarettes, can be removed.

In FIG. 2B, the lid 3 is shown in a position in which it is moved further backwards and away from the access opening 18. This movement is indicated by arrow M1. The lid 3 can be moved due the connecting flap 14 which is separated from the rear wall 8 of the package 1 by the two cuts (or weakening lines, perforation lines, creasing lines along which the rear wall of the package is ripped up) 12 and 13 shown in FIG. 1C. The connecting flap 14 is now rotated around the second hinge 11, while the connecting flap 14 is swiveled out of the rear wall 8 of the package 1.

In FIG. 2C the movement shown in FIG. 2B is continued, but now supplemented by a rotation of the lid 3 in the direction of arrow R2. This second rotation of the lid 3 has a clockwise direction (counter-clockwise from the left side of the package). The second rotation R2 is therefore in an opposite direction of the first rotation R1.

The (almost) open end position of the lid 3 is shown FIG. 2D. The lid 3 abuts with its front wall 5 on the rear wall 8 of the package 1. The connecting flap 14 aligns with the lower edge 19 of the right side wall 16 of the lid 3. In other words, the lid 3 is now entirely folded into the connecting flap 14. The package 1 can now be placed with its rear side on a substantially flat surface 20 as shown in FIG. 3.

In order to close the package, the stages shown in FIG. 2A to 2D are performed in reverse order from FIG. 2D to 2A.

Figure 3:
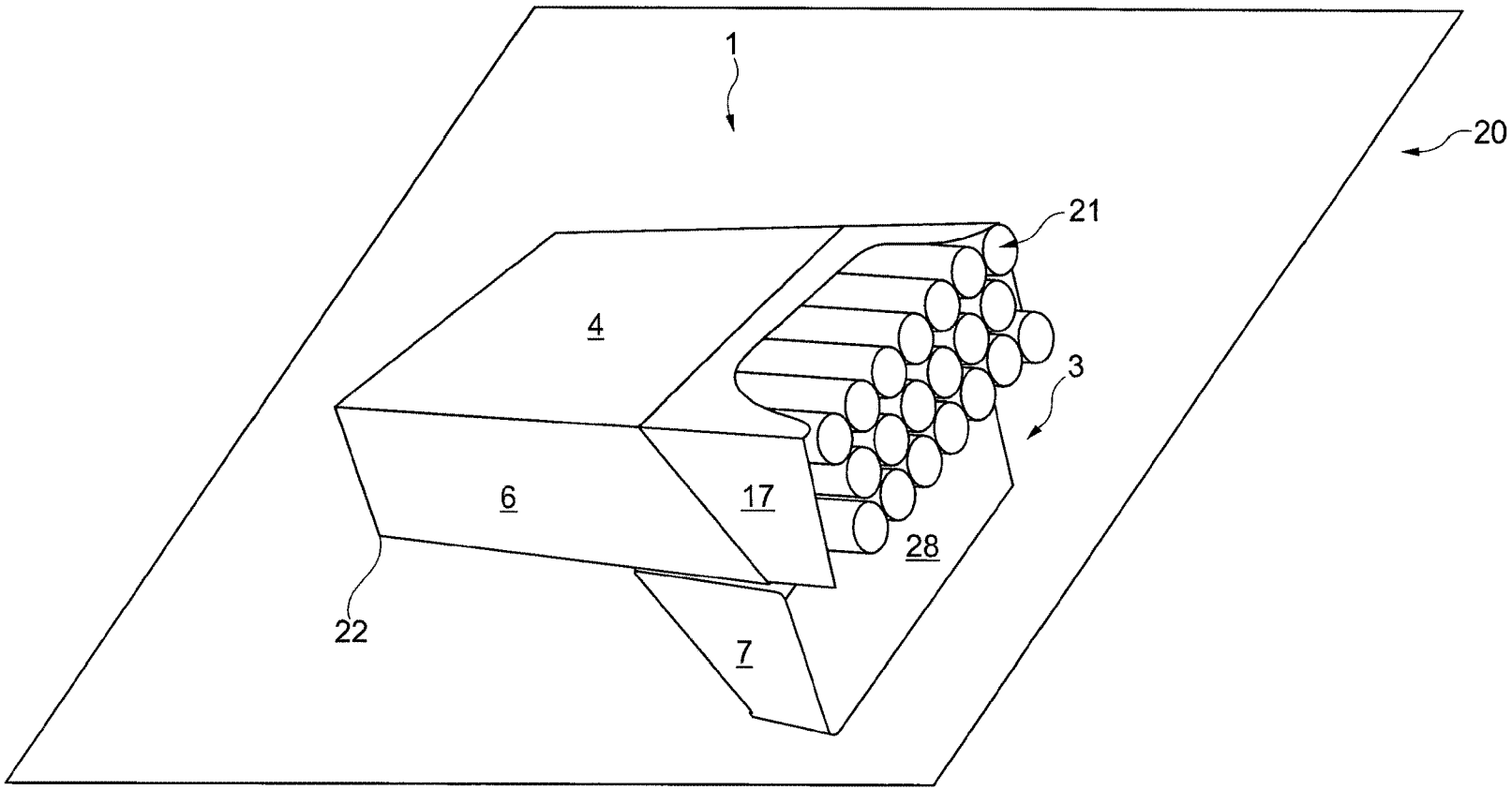
FIG. 3 shows a simplified perspective view of the package of FIG. 1 and FIG. 2 when the lid is in the open end position.

FIG. 3 shows the package 1 of FIG. 1 and FIG. 2 in the appealing open end position of the lid 3. The lid 3 is folded into the connecting flap 14 as described with respect to FIG. 2A to 2D. If the front wall 5 of the lid 3 abuts on the rear wall 8 of the package 1, the package 1 can be placed on a mainly flat surface 20 and remains open. The top wall 28 of the lid 3 is substantially perpendicular to the front wall 4 (and rear wall 8, not visible here) of the package 1. The lid serves as support for the upper part of the package 1 where the access opening 18 of the package 1 is located. The lower rear edge 22 of the package 1 rests on the flat surface 20. The elongate articles 21 therefore assume an inclined position in which the access opening 18 of the package 1 points upwardly from the flat surface 20 and towards a potential consumer. Dependent on the length and configuration of the first and second hinge, the length of the connecting flap and the used materials for the package, the lid 3 may remain in the end position by itself. However, the weight of the package also supports that the lid 3 remains stuck between the connecting flap 14 and the rear wall 8 of the package 1. The dimensions and materials of the package 1 have to chosen such that the lid 3 cannot return by itself into a closed position at least when the package is placed on surface 20 and rests with its rear wall 8 on the lid 3 as shown in FIG. 3.

Figure 4:
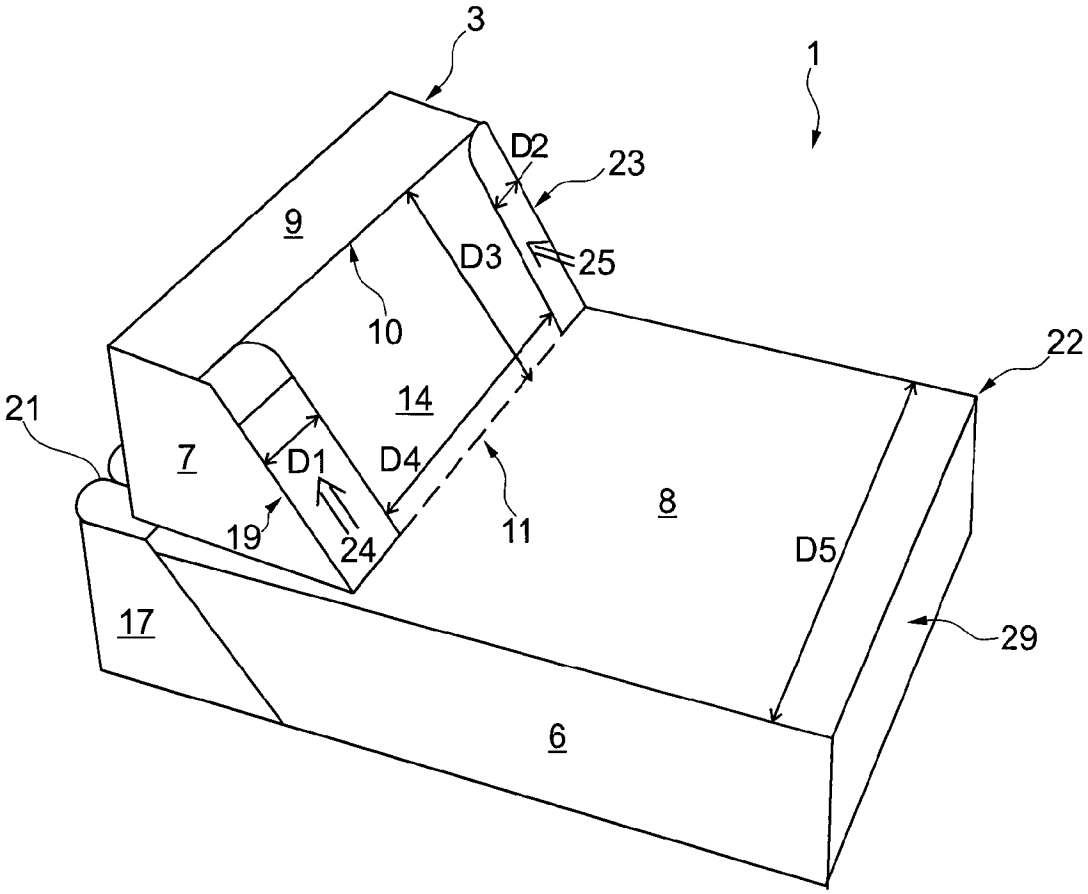
FIG. 4 shows the package of FIG. 3 from the rear side.

FIG. 4 shows the package 1 of FIG. 1 to FIG. 3 from the rear side. In this view, the bottom wall 29 of the body 2 of the package is visible. The connecting flap 14 extends from the second hinge 11 to the first hinge 10. In the shown open end position, the connecting flap 14 runs in parallel with the lower edges 19 and 23 of the side walls 7 and 16 of the lid 3. The front wall 5 (not visible) of the lid 3 abuts on the rear wall 8 of the package. The length D3 of the connecting flap 14 corresponds substantially to the length of the lower edges 19 and 23 of the side walls 7, 16 of the lid 3. This prevents the lid 3 from unfolding and holds the package 1 in the stable end position shown in FIG. 3.

The distances D1 and D2, shown in FIG. 1A, provide that two openings 24 and 25 are created. This is due to the fact that the connecting flap 14 only has a width D4, which is smaller than the width D5 of the package. The ratio D4/D5 has to be carefully chosen in order to keep the rear wall 8 of the package 1 stable enough. The distances D1 and D2 can range from 0 mm to 15 mm, preferably from 5 mm to 10 mm. This provides a ratio D4/D5 that ranges between 1 to 1/10, advantageously up 1/20.

Figure 5:
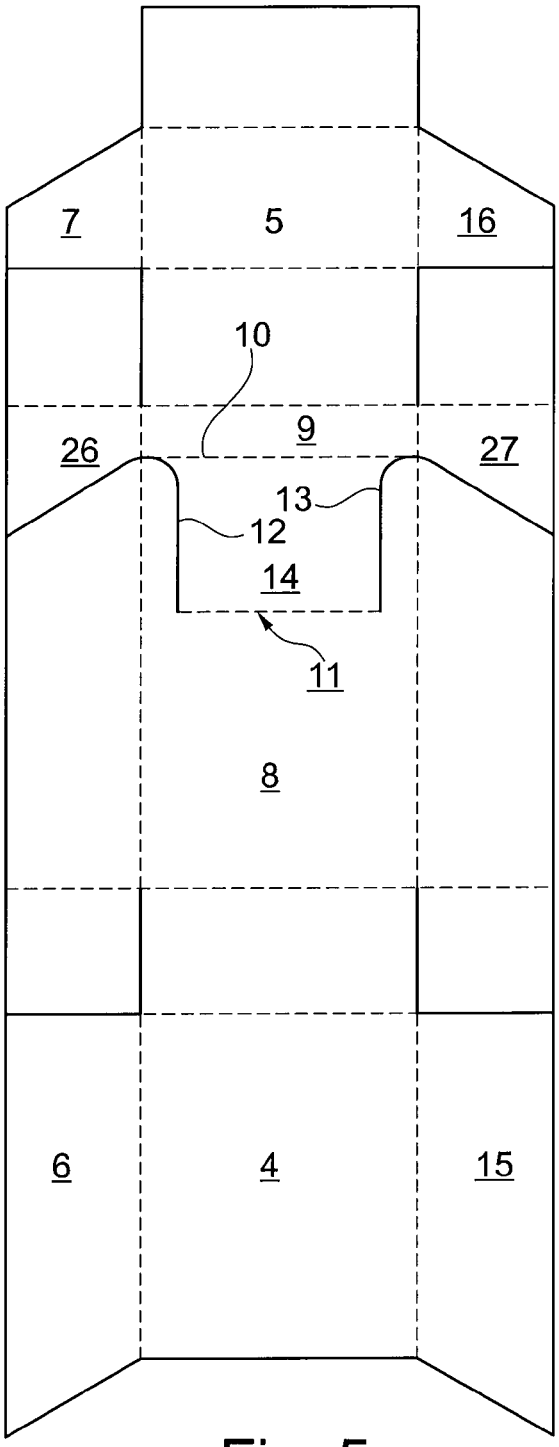
FIG. 5 shows a blank for the package shown in FIG. 1 to FIG. 4.

FIG. 5 shows a blank that is suitable for manufacturing the package shown in FIG. 1 to FIG. 4. Solid lines represent cuts while dashed lines represent folds. Cuts 12, 13 are running along the lower edges of two flaps 26, 27 which are folded behind side walls 7, 16 of lid 3. Other areas of the blank without reference numbers are also folded inside the package. The two cuts 12, 13 mainly define the functionality of the package 1 and whether the stable end position can be assumed when the lid 3 is folded behind the rear wall 8 of the package 1.

Although the invention has been described hereinabove with reference to specific embodiments, it is not limited to these embodiments and no doubt further alternatives will occur to the skilled person that lie within the scope of the invention as claimed.

The invention claimed is:

1. A hinged lid package for elongate smoking articles, the package comprising a body having a front wall, a rear wall, a bottom wall and two side walls, the package further comprising a lid which is hinged to the rear wall of the body by a first hinge, the lid comprising a front wall, a rear wall, a top wall and two side walls, wherein the lid and the body being coupled such that the body can rest on the lid in an open end position of the lid and the lid remains open, wherein the package further comprises a second hinge inside the rear wall of the body and two cuts, or creasing lines, or lines of perforation, or weakening lines, in the rear wall of the body running from the first hinge to the second hinge so as to create a connecting flap in the rear wall of the body which couples the first hinge and the second hinge, wherein the length of the connecting flap is equal to the length of lower edges of the side walls of the lid.

2. The package according to claim 1, wherein the cuts or lines have a distance from the side walls of the package such that the width of the connecting flap is smaller than the width of the rear wall of the package.

3. The package according to claim 2, wherein the width of the rear wall is larger than the width of the first hinge.

4. The package according to claim 3, wherein the two cuts follow the first hinge outwardly in opposite directions and towards the side walls of the package, such that the first hinge is partially cut.

5. The package according to claim 4, wherein the second hinge is parallel to the first hinge.

6. The package according to claim 5, wherein the package is configured such that the front wall of the lid abuts on the rear wall of the package when the lid is in the open end position.

7. The package according to claim 6, wherein the package is further configured such that the lid supports the open package in the open end position from the rear side of the package in an inclined position in which the elongate articles are inclined with respect to a flat surface such that ends of the elongate articles which are accessible are more elevated than opposite ends of the elongate articles inside the package.

8. The package according to claim 7, wherein the package is further configured to reach the open end position by swiveling the lid in a first direction of rotation for granting access to the elongate articles contained in the package and by swiveling the lid in a second direction of rotation in order to stabilize the lid in the open end position.

* * * * *